United States Patent [19]

Kobayashi et al.

[11] Patent Number: 4,588,219

[45] Date of Patent: May 13, 1986

[54] DOOR HANDLE UNIT SUITABLE FOR USE IN AN AUTOMOBILE

[75] Inventors: Fumio Kobayashi, Ayase; Hidenobu Kato, Hatano, both of Japan

[73] Assignees: Ohi Seisakusho Co., Ltd., Yokohama; Nissan Shatai Co., Ltd., Hiratsuka, both of Japan

[21] Appl. No.: 406,549

[22] Filed: Aug. 9, 1982

[30] Foreign Application Priority Data

Aug. 13, 1981 [JP] Japan ..... 56-125967

[51] Int. Cl.[4] ..... E05C 3/26

[52] U.S. Cl. ..... 292/336.3; 292/DIG. 31

[58] Field of Search ..... 292/336.3, 347, 196, 292/139, 97, DIG. 31; 74/543, 545, 548, 551.9

[56] References Cited

U.S. PATENT DOCUMENTS

| | | | |
|---|---|---|---|
| 2,657,085 | 10/1953 | Dedoes | 292/DIG. 31 |
| 2,749,167 | 6/1956 | Love | 292/DIG. 31 |
| 2,780,485 | 2/1957 | Dedoes | 292/DIG. 31 |
| 3,528,695 | 9/1970 | Peters | 292/336.3 |
| 3,544,148 | 12/1970 | Sandor | 292/336.3 |
| 3,858,921 | 1/1975 | Kuki | 292/336.3 |
| 3,936,082 | 2/1976 | Swanson | 292/DIG. 31 |
| 3,967,844 | 7/1976 | Torii et al. | 292/336.3 |

FOREIGN PATENT DOCUMENTS

| | | | |
|---|---|---|---|
| 1428550 | 3/1976 | United Kingdom | 292/336.3 |

*Primary Examiner*—Robert L. Wolfe

*Attorney, Agent, or Firm*—Poms, Smith, Lande & Rose

[57] ABSTRACT

A door handle unit suitable for use in an automobile which handle unit includes a handle arm pivotally secured on a door panel with its free end outwardly and retractably extendable through the bottom wall of a recess formed in the door panel, a handle comprising pushing and pulling parts in its end portions, which handle is pivotally attached to the free end of the handle arm so that the handle may be moved between a fully-closing position where the handle covers up the opening of the recess, and an opening position where the desired clearance is established in a part of the opening of the recess, while the free end of the handle arm is settled in the recess, and means which biases the handle toward the fully-closing position. When the handle is in the opening position, the clearance permits a driver or passenger to insert his fingers thereinto so that the handle is pulled to open the door. Since the recess is fully covered up while the door is closed, the problems of air resistance and whistling noise have been solved satisfactorily.

6 Claims, 6 Drawing Figures

DOOR HANDLE UNIT SUITABLE FOR USE IN AN AUTOMOBILE

BACKGROUND OF THE INVENTION

The present invention relates to a door handle unit suitable for use in an automobile which, when installed at a proper location of a door of the automobile, is adapted to release the door lock and to open or close the door.

A conventional outside handle for an automobile door is, as illustrated in FIG. 1 which is given by way of example, required to define a recess c at a suitable location of a door panel b so as to allow a handle a to protrude normally beyond the outer surface of the door panel b and to establish a clearance through which fingers may be inserted underneath the handle a.

The presence of the protrusion such as the door handle a and the recess c is accompanied by such drawbacks that the flow of air is disturbed upon high-speed travelling, thereby developing turbulence therein and thus increasing the air resistance to be encountered while driving and creating a cause for whistling noise as well as the appearance of an automobile is damaged by the incorporation of such prior art door handle units.

SUMMARY OF THE INVENTION

An object of this invention is to provide a door handle unit which is capable of solving the aforementioned drawbacks by making the outer surface of a handle lie in the same plane as the outer surface of its corresponding door panel, when the door handle unit is not operated, so as to avoid the presence of the above-mentioned protrusion and recess.

According to one aspect of this invention, there is thus provided a door handle unit suitable for use in an automobile which comprises (a) a handle arm pivotally secured to a door panel with its free end outwardly and retractably extendable through the bottom wall of a recess formed in the door panel; (b) a handle comprising pushing and pulling parts in its end portions, which handle is pivotally attached to the free end of the handle arm so that the handle may be moved between a fully-closing position where the handle covers up the opening of the recess, and an opening position where the desired clearance is established in a part of the opening of the recess, while the free end of the handle arm is settled in the recess; and (c) means which biases the handle toward the fully-closing position. The handle arm has an elbow-like configuration in preferred embodiments.

Owing to the above construction, the outer surface of the handle lies substantially in the same plane as the outer surface of its corresponding door panel except when the handle is operated. Accordingly, the handle covers up the opening of the recess and the door panel is thus free of any parts protruding therefrom and exposed recess. The door handle unit according to this invention can therefore bring about such merits that it is free from the problem of developing turbulence in the flow of air and generating whistling noise upon driving an automobile at high speeds, it is free of any parts protruding outside an automobile and thus improves its safety, and it gives good-looking appearance.

Furthermore, the door handle can be readily operated only by pushing the handle at its pushing part and inserting fingers into a space formed at the pulling part, which is located opposite to the pushing part, and simply pulling it up by the fingers. Thus, users can enjoy excellent operability of door handle units according to this invention. The door handle is particularly convenient, because its handle can be operated through a comfortable motion of fingers by depressing the pushing part with a thumb and putting the remaining fingers on the pulling part.

BRIEF DESCRIPTION OF THE DRAWINGS

In order that the present invention may be better understood, a preferred embodiment thereof will be described with reference to the accompanying drawings, in which.

DESCRIPTION OF THE PREFERRED EMBODIMENT

Figure 1:
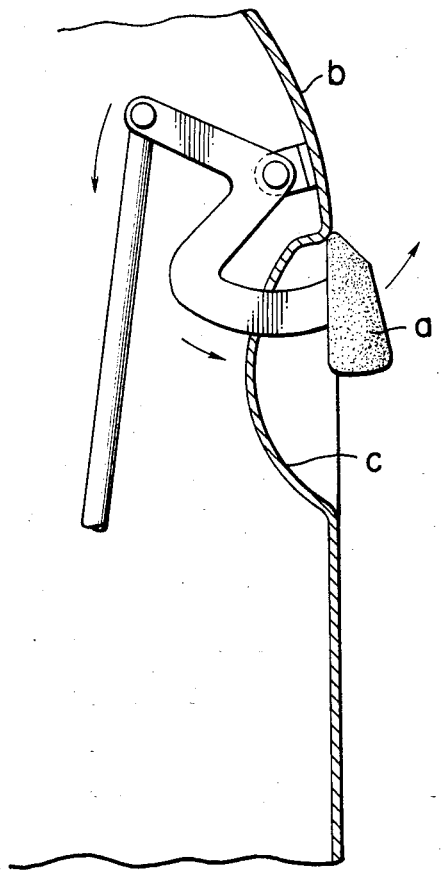
FIG. 1 is a fragmentary vertical cross-section showing an example of a conventional outside door handle for an automobile.
Figure 2:
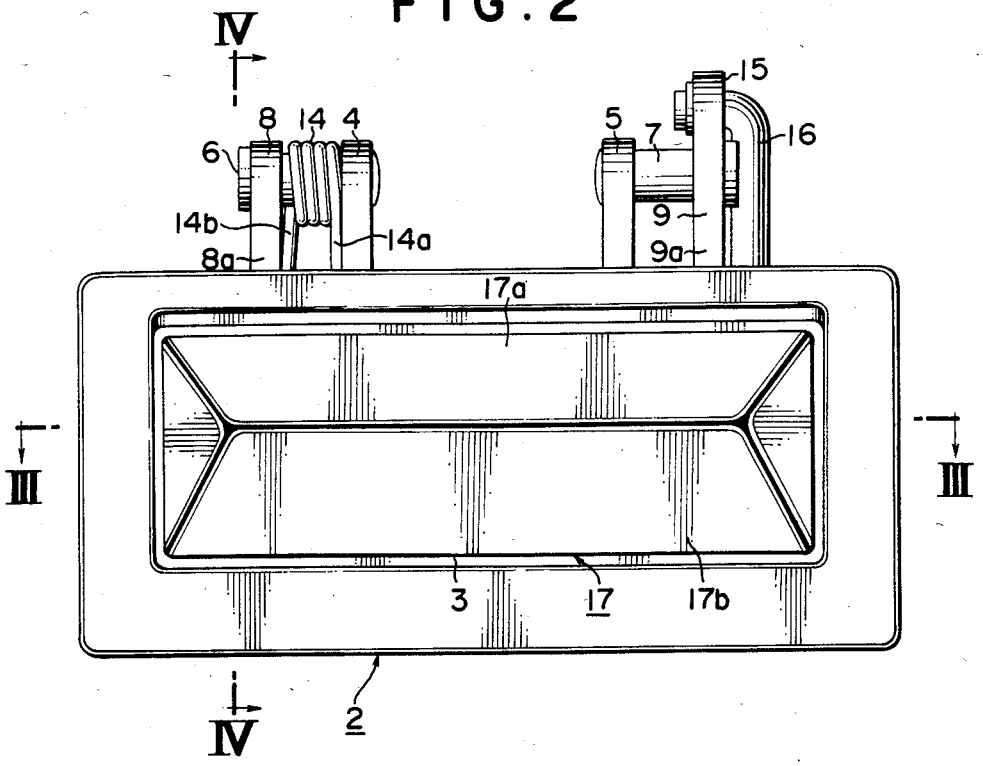
FIG. 2 is a front view of one embodiment of a door handle unit according to this invention.
Figure 3:
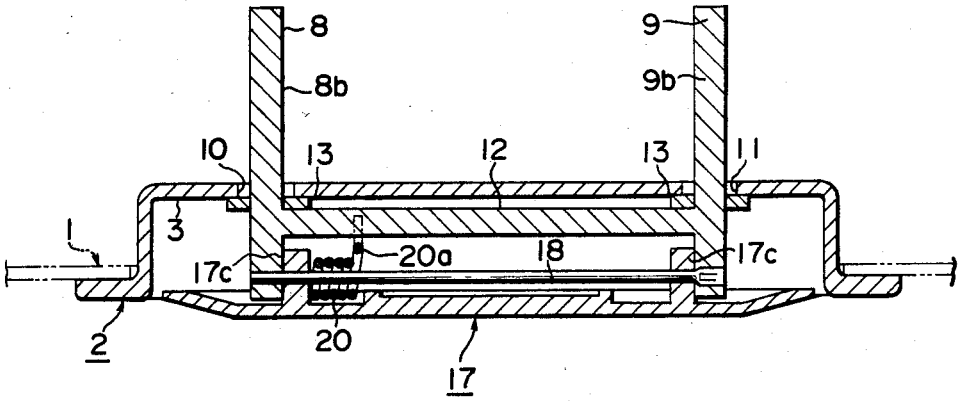
FIG. 3 is a transverse cross-sectional view of the door handle unit, taken along line III—III of FIG. 2.

Referring now to the drawings, there is shown in FIGS. 2–6 one embodiment of a door handle unit according to the present invention. Numeral 1 indicates a door panel of an automobile, at a suitable location of which door panel a casing 2 made of a hard synthetic resin is fixedly attached as an integral part thereof.

The casing 2 defines a horizontally-long, rectangular recess 3 centrally in its front face and is provided at the rear face of its bottom wall with a pair of left and right upright members 4 and 5. Left and right handle arms 8 and 9 are pivotally attached in pair to their corresponding upright members 4 and 5 by means of shafts 6 and 7 which extend horizontally.

The handle arms 8 and 9 are respectively formed of arm portions **8*a* and 9*a*, which extend downwardly and somewhat inwardly from their corresponding shafts 6 and 7, and arcuate portions 8*b* and 9*b* which extend outwardly from the free ends of their corresponding arm portions 8*a* and 9*a* and describe circular arcs about their corresponding shafts 6 and 7**.

The arcuate portions **8*b* and 9*b* extend through openings 10 and 11 formed through the bottom wall of the recess 3 of the casing 2 and extend further into the recess 3. The arcuate portions 8*b* and 9*b* are coupled together in the recess by means of a horizontally-extending cross member 12. Stoppers 13 made of an elastic material such as rubber or the like are fitted on the arcuate portions 8*b* and 9*b* just behind the cross member 12**.

Figure 4:
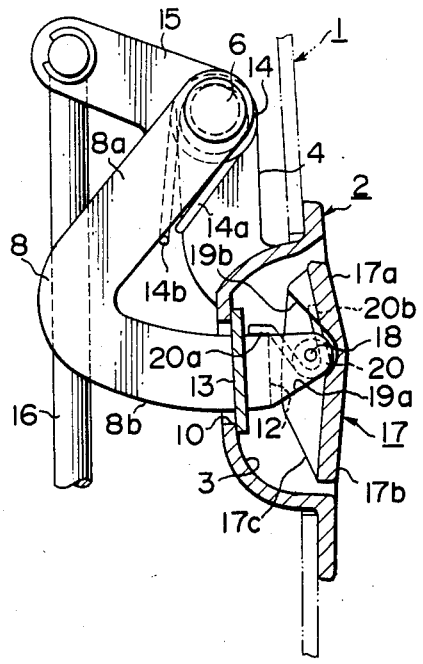
FIG. 4 is a vertical cross-sectional view of the door handle unit, taken along line IV—IV of FIG. 2.
Figure 5:
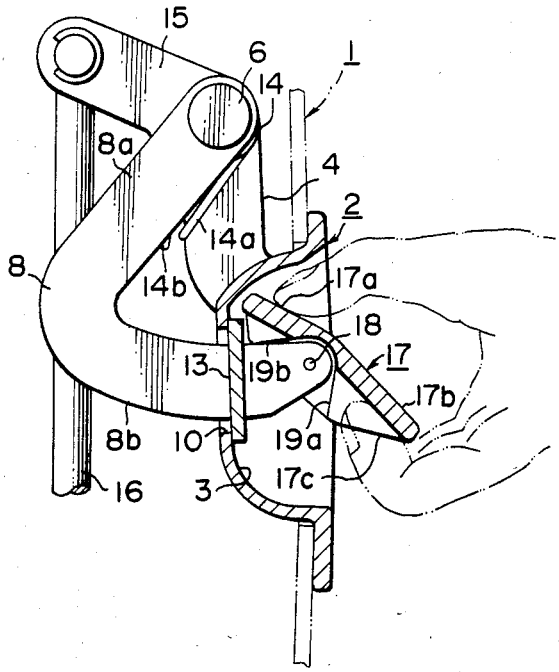
FIG. 5 is a vertical cross-sectional view of the same parts as in FIG. 4, in which the door handle is displaced to the opening position from the closing position shown in FIG. 4.
Figure 6:
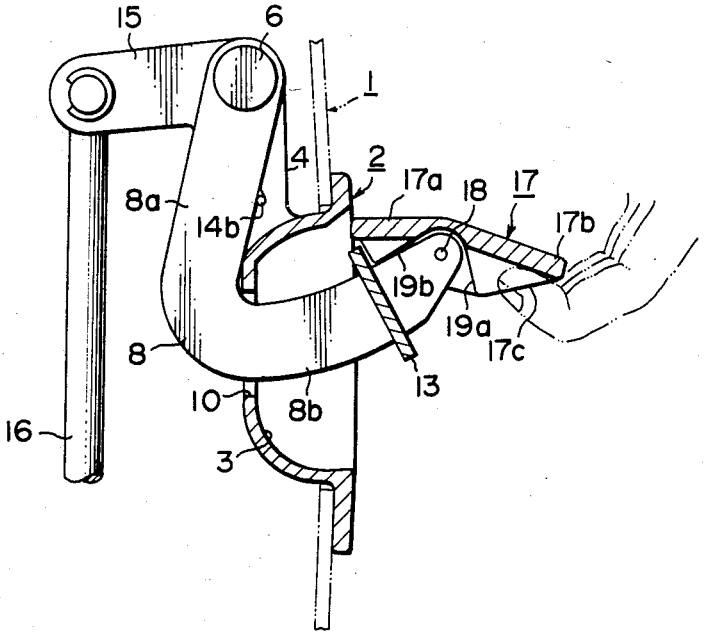
FIG. 6 is a vertical cross-sectional view of the same parts as in FIG. 4, in which the door handle is further displaced to bring the handle arm to an operating position.

Thus, the handle arms 8 and 9 are allowed to swing from the inoperable positions shown in FIGS. 4 and 5, in which the stoppers 13 are in abutment with the outer surface of the bottom wall of the recess 3 of the casing 2, and to the operable position depicted in FIG. 6 where the outer edges of the arm portions 8*a* and 9*a* are in contact with the inner face of the bottom wall of the recess 3 of the casing 2.

Numeral 14 indicates a coil spring fitted on the shaft 6 at a location between one of the handle arms, i.e., the handle arm 8 and its corresponding upright member 4. One of its straight extensions, i.e., the straight extension 14*a* is held by the upright member 4 while the other straight extension, i.e., the straight extension 14*b* is supported by the arm portion 8*a* of the handle arm 8. Owing to the provision of the coil spring 14, both handle arms 8 and 9 are biased toward the inoperable positions.

At the upper extremity of the other handle arm, i.e., the handle arm 9, there is provided an actuating lever 15 which extends inwardly and upwardly. The free end of the actuating lever 15 is connected to the upper extremity of a rod 16 which is coupled at its lower extremity with an operating lever for a door lock (not illustrated).

Accordingly, the free end of the actuating lever 15 is positioned in the higher position when the handle arm 9 is in the inoperable position as shown in FIGS. 4 and 5. In this state, the door lock is maintained in the locked position in which its latch (not shown) is in engagement with its corresponding striker (not illustrated) provided with an automobile body. However, when the handle arm 9 is turned to the operable position as shown in FIG. 6, the actuating lever 15 is downwardly swung in association with the movement of the handle arm 9, thereby causing the operating lever of the door lock to turn to release the door lock and allowing to open the door.

Numeral 17 indicates a horizontally-long, rectangular handle seen in a front elevation. The handle 17 comprises a pushing part 17*a* along its upper edge and a pulling part 17*b* along its lower edge. Inwardly-extending ribs 17*c* are provided on the inner face of the handle 17 at both left and right ends thereof.

Both ribs 17*c* of the handle 17 are pivotally connected to the free ends of their corresponding handle arms 8 and 9 by means of a horizontally-extending fulcrum rod 18. Accordingly, the handle 17 is capable of swing, when the handle arms 8 and 9 are in the unoperable positions, between the fully-closing position shown in FIG. 4 where the handle 17 closes up the opening of the recess 3 of the casing 2 and the opening position where a clearance is established between the lower edge of the opening of the recess 3 and the pulling part 17*b* to such an extent as allowing an insertion of fingers into the clearance.

Numerals 19*a* and 19*b* are stoppers integrally formed on the left side face of the left rib 17*c*. When the handle 17 is in the fully-closing position, the handle 17 is held in place as the lower stopper 19*a* is in abutment with the lower edge of the free end of the handle arm 8. On the other hand, when the handle 17 is in the opening position, the upper stopper 19*b* is in abutment with the upper edge of the free end of the handle arm 8 to hold the handle 17 in place.

Numeral 20 indicates a coil spring adapted to bias the handle 17 toward the fully-closing position. It is fitted on the fulcrum rod 18 in its proper position, between the left and right ribs 17*c*. One of its straight extension, i.e., a straight extension 20*a* is supported by the cross member 12, whereas the other straight extension 20*b* is held by the inner face of the pushing part 17*a* of the handle 17.

Next, the operation and handling of the above door handle unit according to this invention will be described.

When the handle is not operated, for example, when the automobile is driven, the handle arms 8 and 9 are kept in the inoperable positions by the biasing force of the coil spring 14. On the other hand, the handle 17 is held in the fully-closing position by the biasing force of the coil spring 20 (see FIG. 4).

Accordingly, in the above state, the opening of the recess 3 of the casing 2 is almost completely covered by the handle 17. The outer surface of the handle 17 lies substantially in the same plane as the surface of the door panel 1.

In order to open the door, the pushing part 17*a* of the handle 17 is first pushed inwardly by a thumb so as to turn the handle 17 to the opening position as shown in FIG. 5. This permits to establish a clearance between the lower edge of the opening of the recess 3 and the pulling part 17*b* of the handle 17. The remaining fingers are then inserted into the clearance and are put on the pulling part 17*b* from the inside. Then, by pulling the handle 17 upwardly and outwardly, the handle arms 8 and 9 are then swung to operable positions, as illustrated in FIG. 6.

In the course of the swinging motions of the handle arms 8 and 9, the free end of the actuating lever 15 is turned downwardly and the rod 16 is thus pushed down. The rod 16 thus turns the operating lever of the door lock and releases the door lock, thereby opening the door.

As soon as the hand is released from the handle 17, the handle arms 8 and 9 are returned to the initial inoperable positions owing to the biasing force of the coil spring 14. The handle 17 is also returned to the fully-closing position by virtue of the biasing force of the coil spring 20. Thus, they are returned to positions shown in FIG. 4.

In the above embodiment, the present invention is applied to an outside door handle. This invention can also be applied to an inside door handle. An inside door handle incorporating the present invention can bring about such effects that, since the handle does not protrude into the inside of the automobile, the handle does not interfere with the free movement of a passenger, is safe and permits an effective use of the inner space of the automobile.

Although the present invention has been described in some detail by way of illustration and example for purposes of clarity of understanding, it will, of course, be understood that various changes and modifications may be made in the form, details, and arrangements of the parts without departing from the scope of the present invention as set forth in the following claims.

What is claimed is:

1. A door handle system adapted for use in an automobile comprising:

a door panel having an outer surface and an inner surface and a recess present in the outer surface of said door panel, said recess including a bottom wall, side walls and an open top which is flush with the outer surface of the door, said door handle unit comprising:

an elbow-shaped handle arm pivotally secure to a door panel with its free end outwardly and retractably extendable through the bottom wall of said recess, said handle arm being movable between an extended operable position and a retracted inoperable position;

means for biasing said handle arm to said retracted position;

a handle comprising a plate having an inner surface facing said recess, upper edge, lower edge and an outer surface, said outer surface being of sufficient size and shape to matingly fit within said recess at said recess top to substantially completely cover said recess, said plate having an upper pushing part located on the outer surface of said plate along the upper edge thereof and a pulling part located on the inner surface of said plate along the lower edge thereof;

a bifurcated stopper part formed on said handle inner surface, said stopper part having an upper portion and a lower portion disposed to straddle said handle arm free end such that said lower portion abuts said handle arm free end lower edge when said handle is in the closed position and such that said upper portion rocks integrally with said handle into abutment with said handle arm free end upper edge when said handle is in the opening position;

means for pivotally mounting said plate to said handle arm at the handle arm free end so that said plate is pivotable along its longitudinal axis and so that said plate outer surface is substantially flush with the outer surface of said door panel and substantially completely covers said recess open top, whereby said pushing part may be pivotally pushed manually inward from its flush mounted position into said recess when said handle arm is in said retracted inoperable position to thereby pivotally move the plate lower edge out of said recess into a manual access position to provide manual gripping of said pulling part to allow manual movement of said handle arm to said operable position; and means for biasing said plate to said flush mounted position to maintain said plate flush with said door panel outer surface except when said plate is being manually pivoted to the manual access position to provide manual gripping of said pulling part to move said handle arm to said operable position.

2. A door handle unit as defined in claim 1, further comprising another handle arm which is pivotally secured on the door panel in the same manner as said handle arm, and which is coupled together therewith by means of a cross bar.

3. A door handle unit as defined in claim 1 wherein the handle is a rectangular plate.

4. A door handle unit as defined in claim 1, wherein the handle is rotated around a horizontally-extending fulcrum rod.

5. A door handle unit as defined in claim 4, wherein the means for biasing said plate is a coil spring loosely fitted on the fulcrum rod.

6. A door handle unit as defined in claim 1, wherein the handle arm has an elbow-like configuration.

* * * * *